US006592345B2

(12) United States Patent
Suefuji et al.

(10) Patent No.: US 6,592,345 B2
(45) Date of Patent: Jul. 15, 2003

(54) SCROLL COMPRESSOR

(75) Inventors: Kazutaka Suefuji, Kanagawa (JP); Hideaki Ikeda, Kanagawa (JP); Junichi Ikeda, Tokyo (JP)

(73) Assignee: Tokico Ltd., Kawasaki (JP)

( * ) Notice: Subject to any disclaimer, the term of this patent is extended or adjusted under 35 U.S.C. 154(b) by 0 days.

(21) Appl. No.: 10/058,731

(22) Filed: Jan. 30, 2002

(65) Prior Publication Data

US 2002/0102174 A1 Aug. 1, 2002

(30) Foreign Application Priority Data

Jan. 31, 2001 (JP) ..... 2001/024354

(51) Int. Cl.[7] ..... F04C 18/00
(52) U.S. Cl. ..... 418/55.4
(58) Field of Search ..... 418/55.4

(56) References Cited

U.S. PATENT DOCUMENTS 5,366,358 A * 11/1994 Grenci et al. ..... 418/55.4
6,210,137 B1 4/2001 Kobayashi et al.

FOREIGN PATENT DOCUMENTS

JP 55064180 A * 5/1980 ..... F04C/18/02
JP 57068578 A * 4/1982 ..... F04C/18/04
JP 01142286 A * 6/1989 ..... F04C/18/02
JP 01177479 A * 7/1989 ..... F04C/18/02
JP 04287887 A * 10/1992 ..... F04C/18/02
JP 05231359 A * 9/1993 ..... F04C/18/02
JP 06249166 A * 9/1994 ..... F04C/18/02

* cited by examiner

*Primary Examiner*—Thomas Denion
*Assistant Examiner*—Theresa Trieu
(74) *Attorney, Agent, or Firm*—Wenderoth, Lind & Ponack, L.L.P.

(57) ABSTRACT

There is provided a scroll compressor comprising: a fixed-side member comprising a casing and a fixed scroll member provided in the casing; a driving shaft rotatably provided in the casing; an orbiting scroll member orbitably provided at a distal end of the driving shaft; a suction opening provided in the fixed-side member; and a discharge opening provided in the fixed-side member. Each of the scroll members includes an end plate and a spiral wrap portion standing on the end plate. The wrap portion of the orbiting scroll member is adapted to overlap the wrap portion of the fixed scroll member so as to define a plurality of compression chambers. The suction opening communicates with the outermost compression chamber, and the discharge opening is adapted to discharge a compressed gas from an inner compression chamber. A seal member comprising an elastic member is provided around an outer circumferential surface of the orbiting scroll member, so as to seal the compression chambers relative to outside air between the orbiting scroll member and the fixed-side member. The seal member has an opening on a radially inner side thereof and has a generally U-shaped cross-section.

16 Claims, 7 Drawing Sheets

SCROLL COMPRESSOR

BACKGROUND OF THE INVENTION

The present invention relates to a scroll compressor which is used to compress a gas. More specifically, the present invention relates to a scroll compressor which is advantageously used for a booster connected to a city gas supply pipe to increase the pressure of a gas.

Generally, a scroll compressor comprises a casing, a fixed scroll member provided in the casing, which includes an end plate and a spiral wrap portion standing on the end plate, a driving shaft rotatably provided in the casing, and an orbiting scroll member orbitably provided at a distal end of the driving shaft, which orbiting scroll member is adapted to transfer a compressed gas from a suction opening to a discharge opening. The orbiting scroll member includes an end plate and a spiral wrap portion standing on the end plate. The wrap portion of the orbiting scroll member is adapted to overlap the wrap portion of the fixed scroll member so as to define a plurality of compression chambers.

In the scroll compressor of this type, the orbiting scroll member is subject to an orbital motion, with a predetermined orbiting radius (or eccentric distance) about the center axis of the fixed scroll member. Thus, a gas sucked in from the suction opening provided at an outer periphery of the fixed scroll member is compressed in each compression chamber between the wrap portions of the fixed and orbiting scroll members, and discharged to the outside through the discharge opening provided at a central portion of the fixed scroll member.

When the above-mentioned scroll compressor is applied to compressing a refrigerant for air conditioning or a cooling operation, since the pressure of the refrigerant (in gaseous form) at the suction opening is higher than atmospheric pressure, a problem arises, such that the refrigerant at the suction opening is likely to escape to the outside through a space between the outer peripheries of the fixed scroll member and the orbiting scroll member. Therefore, as a refrigerant compressor in the related art, a closed-type compressor has been employed, in which the main body of the compressor is confined in a container, together with an electric motor for rotating the driving shaft.

In a closed-type compressor, the inside of the container is shielded from outside air. Therefore, in order to cool the compressor which is heated during operation, a cooling method using a gas to be compressed by the compressor or a cooling method using a lubricant is required to be used.

When a closed-type compressor is used as a refrigerant compressor, it has no cooling problem. However, when it is applied to compressing a gas having a low heat capacity, such as a city gas, a cooling ability of the gas is insufficient, so that the compressor cannot be cooled to a satisfactory level.

On the other hand, in a cooling method using a lubricant, it is difficult to separate a compressed gas and the lubricant. This makes it difficult to apply the compressor to, for example, a city gas booster. Further, this method cannot be employed in an oilless-type compressor using no lubricant.

When an oilless-type compressor exposed to outside air is applied to compressing a high-pressure gas such as that in a city gas supply pipe, the gas leaks from the suction opening to the outside.

SUMMARY OF THE INVENTION

The present invention has been made, in view of the above-mentioned problems accompanying the related art. It is an object of the present invention to provide a scroll compressor which prevents leakage of a gas even when a gas having a pressure higher than atmospheric pressure is compressed.

The present invention provides a scroll compressor comprising:

- a fixed-side member comprising a casing and a fixed scroll member provided in the casing, the fixed scroll member including an end plate and a spiral wrap portion standing on the end plate;
- a driving shaft rotatably provided in the casing;
- an orbiting scroll member orbitably provided at a distal end of the driving shaft, the orbiting scroll member including an end plate and a spiral wrap portion standing on the end plate, the wrap portion of the orbiting scroll member being adapted to overlap the wrap portion of the fixed scroll member so as to define a plurality of compression chambers;
- a suction opening provided in the fixed-side member so as to communicate with the outermost compression chamber of the plurality of compression chambers;
- a discharge opening provided in the fixed-side member so as to discharge a compressed gas from an inner compression chamber of the plurality of compression chambers to the outside; and
- a seal member comprising an elastic member provided around an outer circumferential surface of the orbiting scroll member, so as to seal the plurality of compression chambers relative to outside air between the orbiting scroll member and the fixed-side member, the seal member having an opening on a radially inner side thereof and having a generally U-shaped cross-section.

The present invention also provides a scroll compressor comprising:

- a casing;
- a fixed scroll member provided in the casing, the fixed scroll member including an end plate and a spiral wrap portion standing on the end plate;
- a driving shaft rotatably provided in the casing;
- an orbiting scroll member orbitably provided at a distal end of the driving shaft, the orbiting scroll member including an end plate and a spiral wrap portion standing on the end plate, the wrap portion of the orbiting scroll member being adapted to overlap the wrap portion of the fixed scroll member so as to define a plurality of compression chambers;
- a suction opening communicated with the outermost compression chamber of the plurality of compression chambers;
- a discharge opening adapted to discharge a compressed gas from an inner compression chamber of the plurality of compression chambers to the outside; and
- a seal apparatus provided on an outer circumferential surface of the orbiting scroll member, so as to seal the plurality of compression chambers relative to outside air between the orbiting scroll member and the fixed scroll member, the seal apparatus comprising:

- a grooved, annular seal mounting member having an opening, the annular seal mounting member being attached to the outer circumferential surface of the orbiting scroll member so that the opening of the groove faces the fixed scroll member; and
- a ring-shaped seal member for providing an gas-tight seal between the fixed scroll member and the orbiting scroll member, the seal member being attached to the groove of the annular seal mounting member so as to allow a part of the gas to flow into the inside of the seal member and increase sealing performance of the seal member.

The foregoing and other objects, features and advantages of the present invention will be apparent from the following detailed description and appended claims taken in connection with the accompanying drawings.

DETAILED DESCRIPTION OF THE PREFERRED EMBODIMENTS

Hereinbelow, referring to the accompanying drawings, description is made in detail with regard to a scroll compressor according to embodiments of the present invention, in which a scroll gas compressor connected to a city gas supply pipe is taken as an example.

Figure 1:
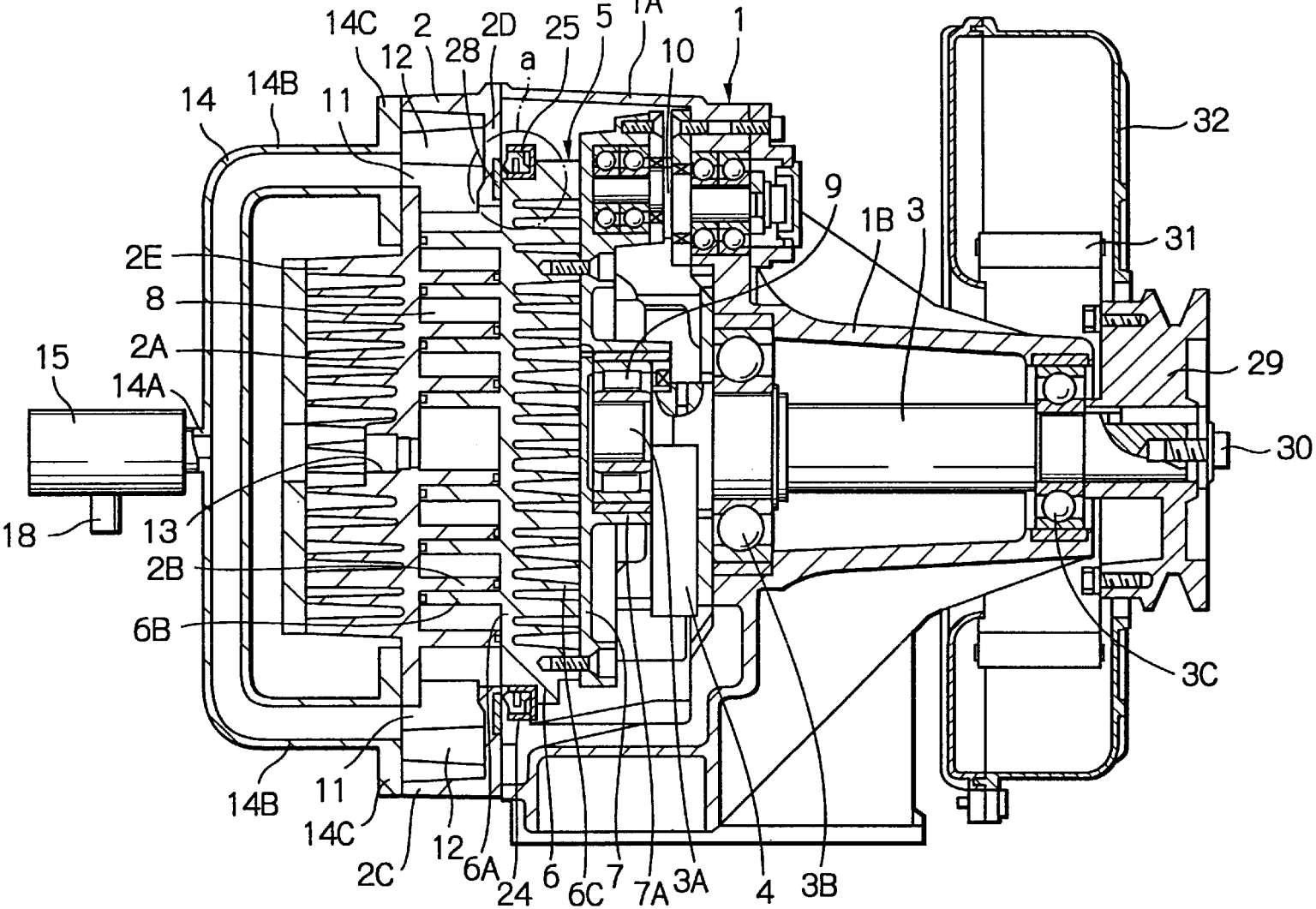
FIG. 1 is a vertical cross-sectional view of a scroll gas compressor according to a first embodiment of the present invention.
Figure 2:
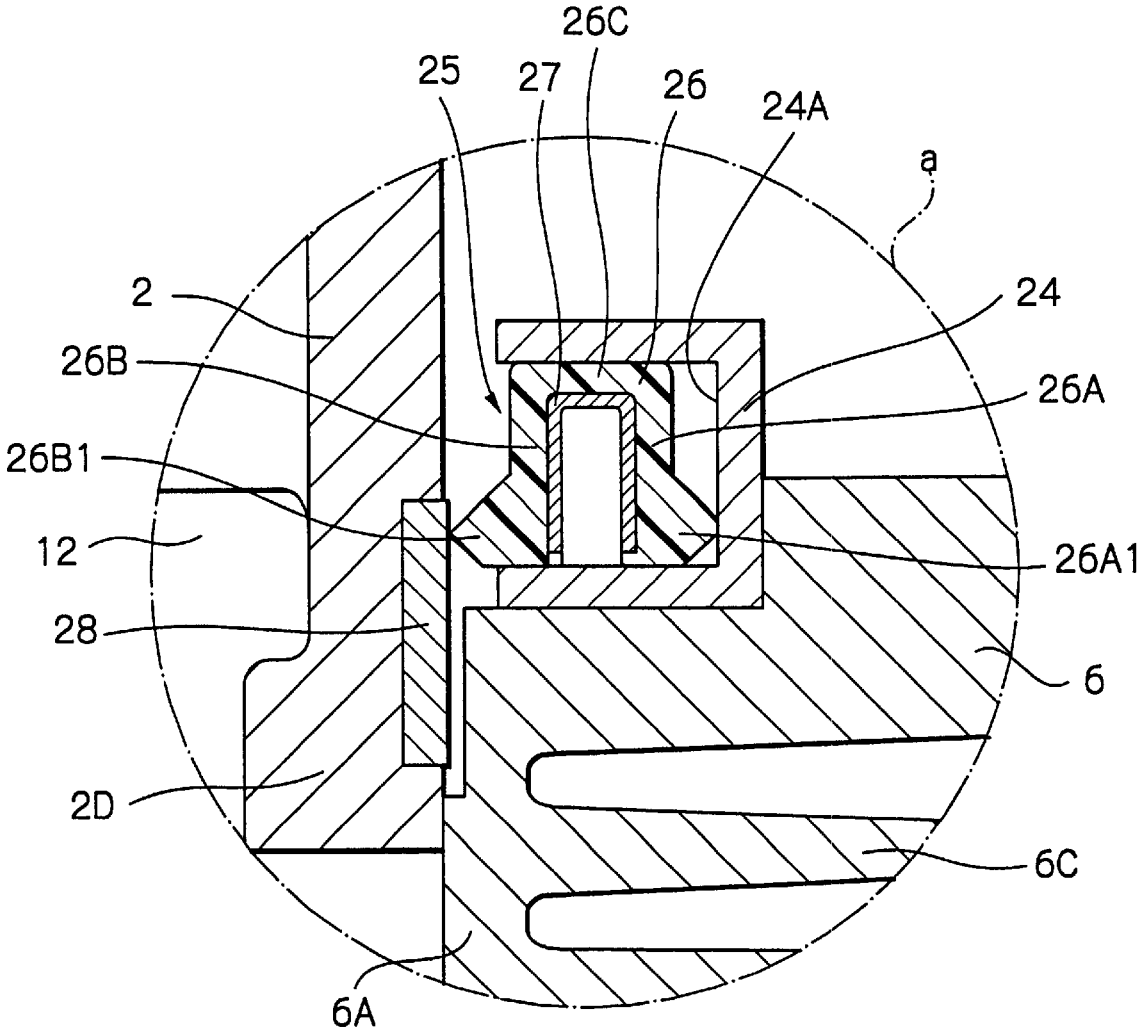
FIG. 2 is an enlarged view of a portion a in FIG. 1.

FIGS. 1 and 2 show a first embodiment of the present invention. Reference numeral 1 denotes a casing providing an outer frame of a scroll gas compressor. The casing 1 and a fixed scroll member 2 (described below) provide a fixed-side member. The casing 1 is in a stepped cylindrical form and comprises a large-diameter portion 1A and a small-diameter portion 1B.

The fixed scroll member 2 is fixed to the large-diameter portion 1A of the casing 1. The fixed scroll member 2 generally comprises: an end plate 2A in the form of a circular plate disposed in a coaxial relationship to a driving shaft 3 (described later); a spiral wrap portion 2B standing on an obverse side of the end plate 2A; an outer edge portion 2C disposed radially outward of the end plate 2A so as to surround the wrap portion 2B; and a ring-receiving portion 2D in a platy form extending vertically from the outer edge portion 2C toward the center axis of the end plate 2A. A number of radiating fins 2E are provided on a rear side of the end plate 2A. The outer edge portion 2C of the fixed scroll member 2 is connected integrally to a distal end of the large-diameter portion 1A of the casing 1.

A crank 3A is provided so as to project from a distal end of the driving shaft 3. The driving shaft 3 is rotatably supported through bearings 3B and 3C in the small-diameter portion 1B of the casing 1. The driving shaft 3 has a pulley 29 (described later) attached to a proximal end thereof and rotates on its axis. The axis of the crank 3A is displaced from the axis of the driving shaft 3 by a predetermined distance.

Reference numeral 4 denotes a balance weight fixed to the distal end of the driving shaft 3. The balance weight 4 is used to obtain a rotational balance of the driving shaft 3 relative to an orbital motion of an orbiting scroll member 5 described later.

The orbiting scroll member 5 is orbitably provided in the casing 1 so as to face the fixed scroll member 2. The orbiting scroll member 5 comprises an orbiting scroll main body 6 and a rear plate 7. The orbiting scroll member 5 is orbitably supported on the crank 3A using an orbiting bearing 9 (described later).

The orbiting scroll main body 6 has substantially the same structure as the fixed scroll member 2 and comprises an end plate 6A and a spiral wrap portion 6B. A number of radiating fins 6C are provided on the end plate 6A. The orbiting scroll member 5 is disposed in a manner such that the wrap portion 6B overlap the wrap portion 2B of the fixed scroll member 2 with a predetermined offset angle of, for example, 180° C., to thereby form a plurality of compression chambers 8 between the wrap portion 2B and the wrap portion 6B.

The rear plate 7 is fixed to distal ends of the radiating fins 6C of the orbiting scroll main body 6. A central portion of the rear plate 7 is integrally formed with a boss portion 7A.

The orbiting bearing 9 is provided in the boss portion 7A of the rear plate 7 so as to receive the crank 3A of the driving shaft 3. Thus, the orbiting bearing 9 supports the orbiting scroll member 5 relative to the crank 3A of the driving shaft 3, in a manner such that the orbiting scroll member 5 can be subject to an orbital motion.

Reference numeral 10 denotes a plurality of auxiliary cranks (only one auxiliary crank 10 is shown in FIG. 1) provided between the casing 1 and the rear plate 7 of the orbiting scroll member 5. Each auxiliary crank 10 is adapted to prevent the orbiting scroll member 5 from rotating on its own axis when the orbiting scroll member 5 is subject to an orbital motion.

Reference numeral 11 denotes two suction openings formed at an outer periphery of the fixed scroll member 2. Each suction opening 11 is open to a suction chamber 12 defined at the outer periphery of the fixed scroll member 2. Each suction opening 11 is connected to a supply pipe 14 (described later). The suction chamber 12 is communicated with the outermost compression chamber 8 of the above-mentioned compression chambers 8. Thus, during operation of the compressor, a gas supplied from the supply pipe 14 flows through the suction openings 11 and the suction chamber 12 into the outermost compression chamber 8.

Reference numeral 13 denotes a discharge opening formed at a central portion of the end plate 2A of the fixed scroll member 2. The discharge opening 13 is open to the innermost compression chamber 8 so as to discharge a compressed gas to the outside.

The supply pipe 14 has a U-shaped configuration. The supply pipe 14 includes a centrally located inlet pipe 14A and two outlet pipes 14B branched off from the inlet pipe 14A. A distal end of each outlet pipe 14B forms a flange 14C connected to each suction opening 11 of the fixed scroll member 2. The supply pipe 14 is adapted to supply a gas, which has flowed through a suction pressure adjusting valve 15 provided at the inlet pipe 14A, to the suction chamber 12 through the suction openings 11.

Reference numeral 24 denotes an annular seal mounting member having a generally U-shaped cross-section. The seal mounting member 24 is formed from, for example, a metallic material. As shown in FIG. 2, the seal mounting member 24 is press fitted over an outer circumferential surface of the orbiting scroll main body 6, and used for mounting of a contact seal 25 (described later). The seal mounting member 24 is provided on the outer circumferential surface of the end plate 6A so as to surround the orbiting scroll main body 6. The seal mounting member 24 includes a seal mounting groove 24A having a distal end thereof open toward the ring-receiving portion 2D of the fixed scroll member 2. The seal mounting groove 24A provides an annular groove having an opening facing the fixed scroll member 2.

The contact seal 25 is provided as a seal member attached to the seal mounting groove 24A of the seal mounting member 24. The contact seal 25 comprises a ring-shaped body seamlessly extending in a circumferential direction so as to provide an gas-tight seal between the fixed scroll member 2 and the orbiting scroll member 5.

The contact seal 25 comprises a seal ring 26 and a spring member 27. The seal ring 26, which is made of a resin material, is provided as an elastic member having an opening on a radially inner side thereof and having a generally U-shaped cross-section. The spring member 27 is provided on an inner circumferential surface of the seal ring 26.

The seal ring 26 comprises: a fixed-side annular plate portion 26A provided at the bottom of the seal mounting groove 24A of the seal mounting member 24; a sliding-side annular plate portion 26B provided at the opening of the seal mounting groove 24A; and a connecting cylindrical portion 26C connecting a radially outer end of the annular plate portion 26A and a radially outer end of the annular plate portion 26B.

The annular plate portion 26A of the seal ring 26 includes a fixed lip portion 26A1 formed at a radially inner end thereof. The fixed lip portion 26A1 is fittingly contained in the seal mounting groove 24A and maintained in contact with the bottom of the groove. The annular plate portion 26B includes a sliding lip portion 26B1 formed at a radially inner end thereof.

The sliding lip portion 26B1 projects from the seal mounting groove 24A and is adapted to be slidably moved relative to a slidable contact ring 28 (described later) provided in the fixed scroll member 2.

The spring member 27 is made of a metallic material (such as stainless steel) and has a generally U-shaped cross-section. The spring member 27 is fittingly connected between the annular plate portion 26A and the annular plate portion 26B, to thereby press the annular plate portion 26A and the annular plate portion 26B in opposite directions and resiliently press the fixed lip portion 26A1 and the sliding lip portion 26B1 against the seal mounting groove 24A and the slidable contact ring 28, respectively.

The slidable contact ring 28 is provided in the ring-receiving portion 2D of the fixed scroll member 2. It comprises a flat ring-shaped body made of a metallic material such as stainless steel. The slidable contact ring 28 is provided between the ring-receiving portion 2D and the end plate 6A of the orbiting scroll member 5. The sliding lip portion 26B1 of the contact seal 25 makes slidable contact with the slidable contact ring 28.

The pulley 29 is connected integrally to the proximal end of the driving shaft 3 by means of a bolt 30. Reference numeral 31 denotes a centrifugal fan connected to the pulley 29. The centrifugal fan 31 is accommodated in a fan casing 32 connected to the small-diameter portion 1B of the casing 1.

The scroll gas compressor in this embodiment is operated in a manner such as mentioned below.

That is, when the driving shaft 3 is rotated by an electric motor (not shown), the orbiting scroll member 5 is subject to an orbital motion with a predetermined orbiting radius about the driving shaft 3. Consequently, the compression chambers 8 defined between the wrap portion 2B of the fixed scroll member 2 and the wrap portion 6B of the orbiting scroll member 5 are continuously contracted. Thus, a gas sucked in from the suction openings 11 of the fixed scroll member 2 is compressed in each compression chamber 8 and discharged through the discharge opening 13 of the fixed scroll member 2 to the outside.

When the compressor is stopped, a pressure in the suction openings 11 is maintained at about atmospheric pressure which is higher than a predetermined value.

In this embodiment, leakage of a gas can be prevented by the contact seal 25. Therefore, differing from the above-mentioned related art, it is not required to accommodate the compressor as a whole in a closed container. Therefore, the number of parts and cost of production can be reduced. Further, the compressor can be easily cooled using various types of cooling means.

The contact seal 25 is provided around the outer circumferential surface of the orbiting scroll member 5 so as to prevent communication between the compression chambers 8 and the outside through a space between the orbiting scroll member 5 and the fixed scroll member 2. Thus, the contact seal 25 provides a seal between the orbiting scroll member 5 and the fixed scroll member 2 and prevents a gas supplied from the suction openings 11 from leaking through the space between the orbiting scroll member 5 and the fixed scroll member 2.

Especially, in this embodiment, the seal mounting groove 24A having an opening facing the fixed scroll member 2 is provided in the orbiting scroll member 5, and the contact seal 25 comprising the seal ring 26 and the spring member 27 is attached to the seal mounting groove 24A. Therefore, the fixed lip portion 26A1 of the seal ring 26 is pressed against the bottom of the seal mounting groove 24A by means of the spring member 27, and the sliding lip portion 26B1 is brought into slidable contact with the fixed scroll member 2 while it is biased toward the fixed scroll member 2 by the spring member 27. Consequently, the space between the fixed scroll member 2 and the orbiting scroll member 5 can be reliably sealed, thus preventing leakage of a gas from the suction chamber 12 through the space between the fixed scroll member 2 and the orbiting scroll member 5 to the outside. That is, by means of the sliding lip portion 26B1, it is possible to prevent leakage of a gas to the outside through the space between the end plate 6A of the orbiting scroll main body 6 and the ring-receiving portion 2D, the space between the orbiting scroll main body 6 and the slidable contact ring 28 and the space between the seal mounting member 24 and the slidable contact ring 28.

Further, a part of the gas prevented from leaking to the outside by the sliding lip portion 26B1 flows through a space between the seal mounting groove 24A of the seal mounting member 24 and the seal ring 26. Namely, a part of the gas flows through a space between an inner peripheral wall surface of the seal mounting groove 24A and the radially inner end of the annular plate portion 26B (i.e., an end of the annular plate portion 26B on a side of the orbiting scroll main body 6), and is taken into the spring member 27 having a U-shaped cross-section, thus increasing a pressure of the gas inside the spring member 27. Consequently, the fixed lip portion 26A1 of the seal ring 26 is pressed with a large force against the bottom of the seal mounting groove 24A while the sliding lip portion 26B1 is pressed with a large force against the fixed scroll member 2, due to the effect of spring resiliency of the spring member 27 and the pressure of the gas inside the spring member 27. Therefore, leakage of a gas to the outside can be more reliably prevented.

Figure 3:
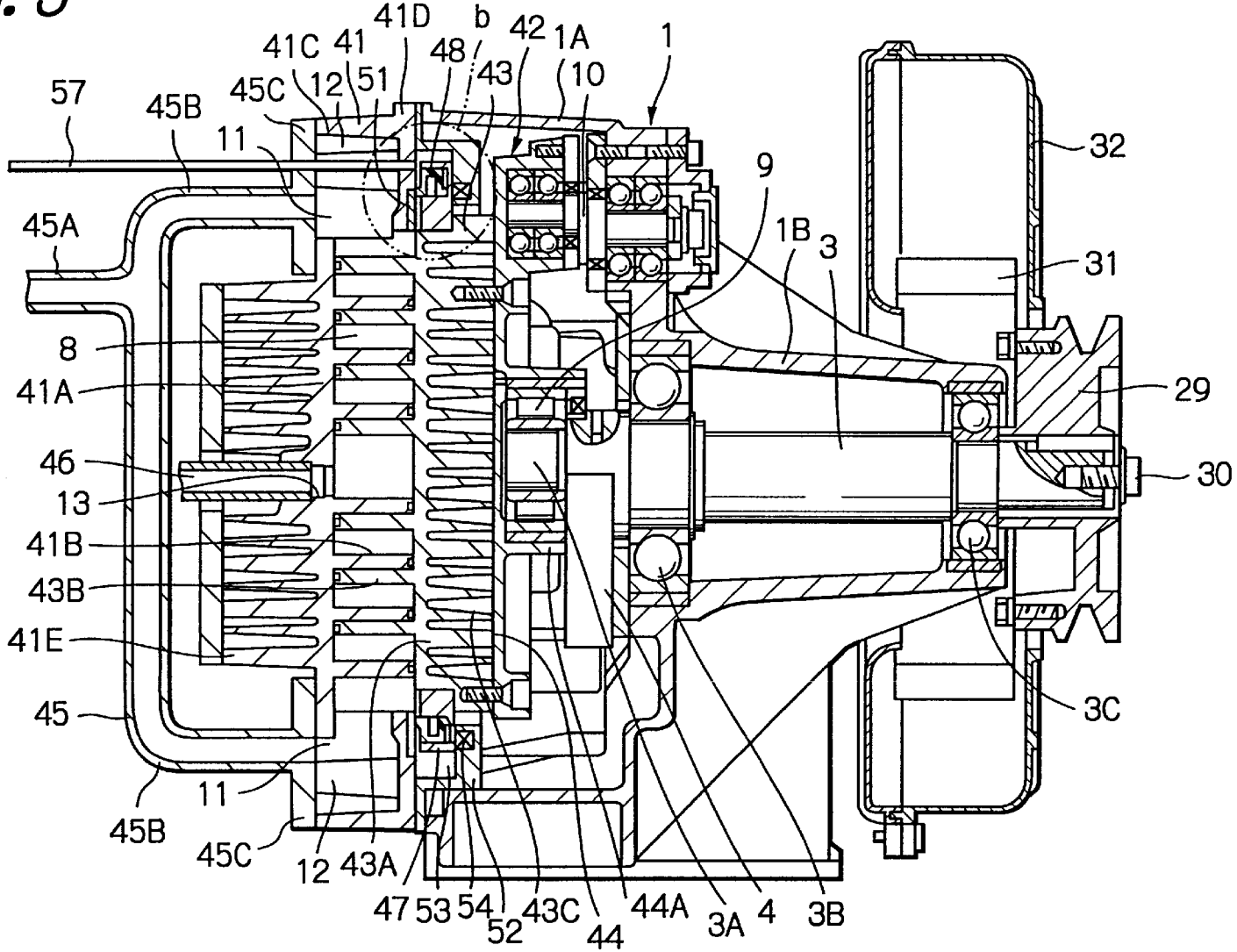
FIG. 3 is a vertical cross-sectional view of a scroll gas compressor according to a second embodiment of the present invention.
Figure 4:
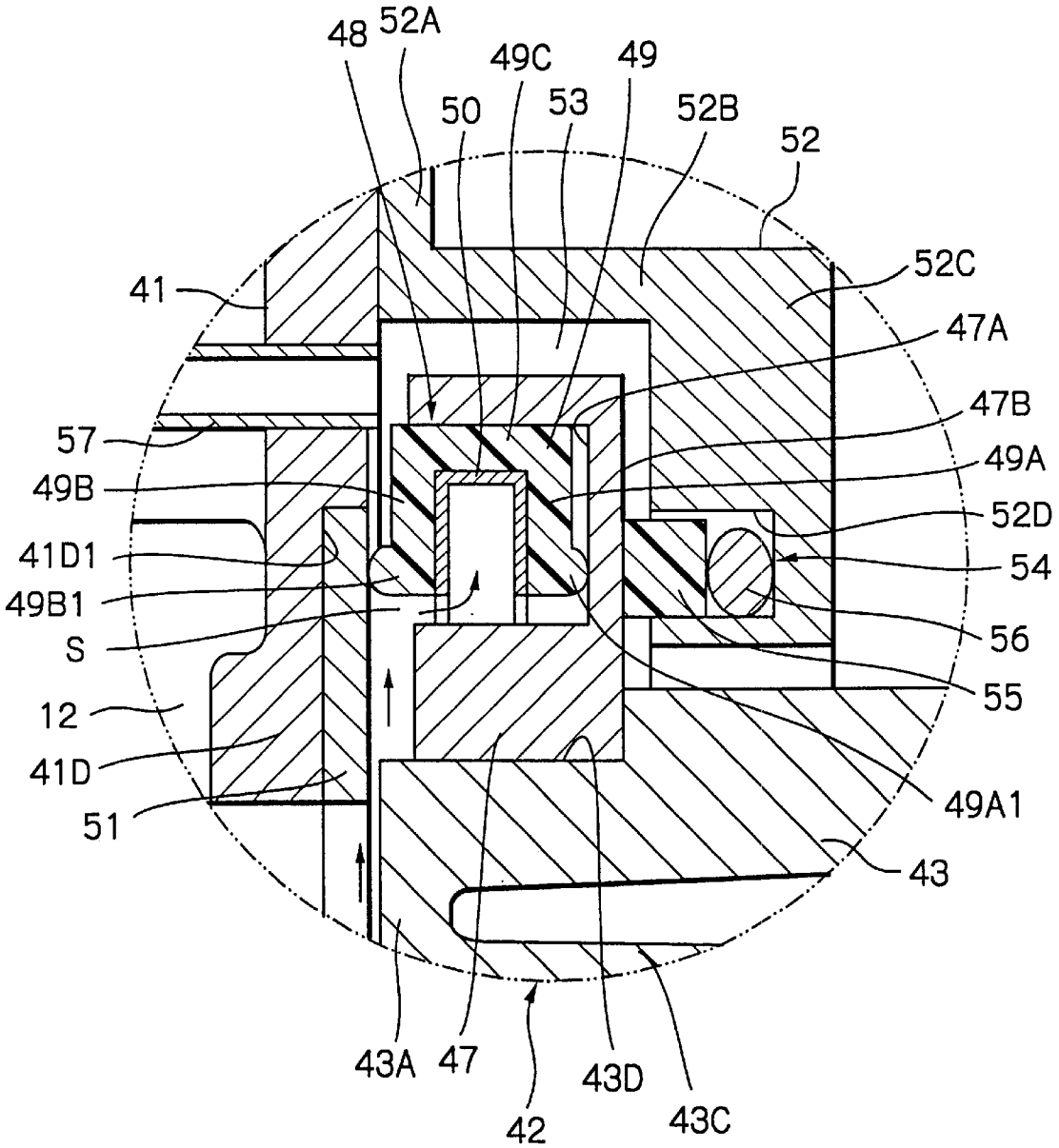
FIG. 4 is an enlarged view of a portion b in FIG. 3.

FIGS. 3 and 4 show a second embodiment of the present invention. The second embodiment is characterized in that an annular partition wall member is provided in the fixed-side member so as to surround the seal mounting member provided on the outer circumferential surface of the orbiting scroll member, an intermediate chamber is formed between the partition wall member and the seal mounting member so as to accommodate a gas which has leaked through the contact seal, an auxiliary seal means is provided so as to enable the gas which has leaked into the intermediate chamber to be sealably contained in the intermediate chamber, and an escape pipe is provided so as to allow an escape of the gas from the intermediate chamber to the outside. The second embodiment is also characterized in that a gas is positively taken into the inside of the seal mounting member.

In the second embodiment, the same portions or elements as used in the first embodiment are designated by the same reference numerals and characters, and an overlapping explanation is omitted.

Reference numeral 41 denotes a fixed scroll member according to this embodiment. The fixed scroll member 41 has substantially the same structure as the fixed scroll member 2 in the first embodiment and comprises an end plate 41A in the form of a circular plate, a wrap portion 41B standing on the end plate 41A, an outer edge portion 41C disposed radially outward of the end plate 41A, a ring-receiving portion 41D formed on an inner circumferential side of the outer edge portion 41C and radiating fins 41E provided on a rear surface of the end plate 41A. The ring-receiving portion 41D of the fixed scroll member 41 is cut to form an annular recess 41D1 having a generally L-shaped cross-section.

Reference numeral 42 denotes an orbiting scroll member according to this embodiment, which is orbitably provided in the casing 1 so as to face the fixed scroll member 41. The orbiting scroll member 42 has substantially the same structure as the orbiting scroll member 5 in the first embodiment and comprises an orbiting scroll main body 43 and a rear plate 44.

The orbiting scroll main body 43 comprises an end plate 43A, a wrap portion 43B and radiating fins 43C. An annular stepped portion 43D is formed in an outer circumferential surface of the end plate 43A for mounting of a seal mounting member 47 (described later). A boss portion 44A is formed in the rear plate 44.

Reference numeral 45 denotes a supply pipe used in this embodiment. The supply pipe 45 includes an inlet pipe 45A and two outlet pipes 45B branched off from the inlet pipe 45A. A distal end of each outlet pipe 45B forms a flange 45C connected to each suction opening 11 of the fixed scroll member 41. The suction pressure adjusting valve 15 (not shown) used in the first embodiment is also provided in the inlet pipe 45A of the supply pipe 45 in this embodiment. Reference numeral 46 denotes a discharge pipe provided at the discharge opening 13.

The inner seal mounting member 47 is provided on the outer circumferential surface of the orbiting scroll member 42. The seal mounting member 47 is made of a metallic material and comprises an annular body having a U-shaped cross-section. The seal mounting member 47 is press fitted over the annular stepped portion 43D of the orbiting scroll member 42.

The seal mounting member 47 includes a seal mounting groove 47A. The seal mounting groove 47A has an opening on an obverse side of the seal mounting member 47 facing the ring-receiving portion 41D of the fixed scroll member 41. A rear side of the seal mounting member 47 provides a slidable contact surface 47B facing a face seal 55 described later.

Reference numeral 48 denotes a contact seal used as a seal member in this embodiment, which is provided in the seal mounting groove 47A of the seal mounting member 47. The contact seal 48 is arranged in substantially the same manner as the contact seal 25 in the first embodiment. It is made of a resin material and comprises a seal ring 49 having an opening on a radially inner side thereof and having a generally U-shaped cross-section, and a spring member 50 provided on an inner circumferential surface of the seal ring 49.

The seal ring 49 comprises: a fixed-side annular plate portion 49A provided at the bottom of the seal mounting groove 47A of the seal mounting member 47; a sliding-side annular plate portion 49B provided at the opening of the seal mounting groove 47A; and a connecting cylindrical portion 49C connecting the annular plate portion 49A and the annular plate portion 49B.

The annular plate portion 49A of the seal ring 49 includes a fixed lip portion 49A1 formed therein. The fixed lip portion 49A1 is fittingly contained in the seal mounting groove 47A and maintained in contact with the bottom of the seal mounting groove 47A. The annular plate portion 49B includes a sliding lip portion 49B1 formed therein. The sliding lip portion 49B1 projects from the seal mounting groove 47A and is adapted to be slidably moved relative to a slidable contact ring 51 provided in the annular recess 41D1 of the fixed scroll member 41.

The spring member 50 is made of a metallic material and has a generally U-shaped cross-section. The spring member 50 is fittingly connected between the annular plate portion 49A and the annular plate portion 49B, to thereby press the annular plate portion 49A and the annular plate portion 49B in opposite directions and resiliently press the fixed lip portion 49A1 and the sliding lip portion 49B1 against the seal mounting groove 47A and the slidable contact ring 51, respectively.

As shown in FIG. 4, a space S is formed between the annular plate portion 49B of the contact seal 48 and an inner peripheral wall surface of the seal mounting groove 47A. Therefore, as indicated by arrows in FIG. 4, a part of a gas sucked in into the suction chamber 12 flows into the inside of the spring member 50 of the contact seal 48 through a space between the end plate 43A of the orbiting scroll member 42 and the slidable contact ring 51, a space between the seal mounting member 47 and the slidable contact ring 51 and the space S between the contact seal 48 and the seal mounting groove 47A. Due to the pressure of the gas flowing into the inside of the spring member 50, the fixed lip portion 49A1 and the sliding lip portion 49B1 of the seal ring 49, together with the spring member 50, are pressed against the seal mounting groove 47A and the slidable contact ring 51, respectively.

Reference numeral 52 denotes an outer seal mounting member as a partition wall member fixedly provided between the large-diameter portion of the casing 1 and the fixed scroll member 41. The seal mounting member 52 comprises an annular flange portion 52A fixedly provided so as to abut against the large-diameter portion 1A of the casing 1 and the ring-receiving portion 41D of the fixed scroll member 41, a cylindrical portion 52B axially extending from an inner circumferential surface of the flange portion 52A and an annular projecting portion 52C projecting radially inward from the cylindrical portion 52B.

The annular projecting portion 52C of the seal mounting member 52 includes an annular seal mounting groove 52D, which faces the slidable contact surface 47B of the seal mounting member 47 and has a generally U-shaped cross-section. The seal mounting member 52 is provided outside the seal mounting member 47 in a manner such that the cylindrical portion 52B and the annular projecting portion 52C surround the seal mounting member 47 in a circumferential direction.

Reference numeral 53 denotes an intermediate chamber formed between the inner seal mounting member 47 and the outer seal mounting member 52. The intermediate chamber 53 provides an annular space having a generally U-shaped cross-section between the seal mounting member 47, and the cylindrical portion 52B and the annular projecting portion 52C of the seal mounting member 52. When a gas from the compression chambers 8 and the suction chamber 12 has leaked through the contact seal 48, it is temporarily accommodated in the intermediate chamber 53.

Reference numeral 54 denotes an auxiliary seal mechanism as an auxiliary seal means provided in the seal mounting groove 52D of the seal mounting member 52. The auxiliary seal mechanism 54 comprises the face seal 55 and a backup ring 56.

The face seal 55 comprises, for example, a seal ring made of an elastic resin material and having a rectangular cross-section. The face seal 55 is fitted into the seal mounting groove 52D and disposed at the opening of the seal mounting groove 52D. The backup-ring 56 is made of an elastic rubber material and disposed in contact with the bottom of the seal mounting groove 52D (at a maximum depth of the groove 52D). The backup ring 56 resiliently presses the face seal 55 toward the slidable contact surface 47B of the seal mounting member 47.

In the auxiliary seal mechanism 54, the face seal 55 provides an gas-tight seal between the seal mounting members 47 and 52 by making slidable contact with the slidable contact surface 47B under resilient force, to thereby enable the gas which has leaked into the intermediate chamber 53 to be sealably contained in the intermediate chamber 53.

Reference numeral 57 denotes an escape pipe as an escape means which is open to the intermediate chamber 53 formed between the seal mounting members 47 and 52. The escape pipe 57 is fixed at one end thereof to the ring-receiving portion 41D of the fixed scroll member 41, and extends through the suction chamber 12 and the flange 45C of the supply pipe 45 to the outside (an outdoor space).

In the second embodiment, the fixed lip portion 49A1 and the sliding lip portion 49B1 of the contact seal 48 provided around the outer circumferential surface of the orbiting scroll member 42 are resiliently pressed against the seal mounting groove 47A and the slidable contact ring 51, respectively. Therefore, the space between the fixed scroll member 41 and the orbiting scroll member 42 can be reliably sealed, thus preventing leakage of a gas from the compression chambers 8 or the suction chamber 12 through the space between the fixed scroll member 41 and the orbiting scroll member 42 to the outside. Thus, in the second embodiment, substantially the same working effect as obtained in the first embodiment can be obtained.

Further, in the second embodiment, the seal mounting member 52 is provided so as to surround the seal mounting member 47 in a circumferential direction, and the intermediate chamber 53 is formed between the seal mounting members 47 and 52. Therefore, if a gas leaks from the compression chambers 8 through the contact seal 48, it can be temporarily accommodated in the intermediate chamber 53. Further, the auxiliary seal mechanism 54 is provided in the seal mounting member 52 so as to provide a seal between the seal mounting members 47 and 52, so that the gas can be sealably contained in the intermediate chamber 53. Thus, the space between the fixed scroll member 41 and the orbiting scroll member 42 can be double-sealed by means of the contact seal 48 and the auxiliary seal mechanism 54, thereby enhancing the sealing performance between the fixed scroll member 41 and the orbiting scroll member 42.

Further, in the second embodiment, the space S is formed between the contact seal 48 and the seal mounting groove 47A, and a gas is positively taken into the inside of the spring member 50 through the space S. Therefore, due to the effect of the spring resiliency of the spring member 50 and the pressure of the gas inside the spring member 50, the fixed lip portion 49A1 and the sliding lip portion 49B1 of the seal ring 49 are pressed with a large force against the seal mounting groove 47A and the slidable contact ring 51, respectively. Thus, leakage of a gas to the outside can be reliably prevented. This action of the spring member 50 and the pressure of the gas inside the spring member 50 also serves to enhance the sealing performance of the auxiliary seal mechanism 54.

In addition, since the escape pipe 57 open to the intermediate chamber 53 is provided, the gas in the intermediate chamber 53 is allowed to escape through the escape pipe 57 to the outside (an outdoor space) and diffuse into the atmosphere. Thus, there is no problem of the gas remaining in an indoor space in which the compressor is installed.

Further, the contact seal 48 and the auxiliary seal mechanism 54 are spaced in an axial direction (in a direction of thrust). Therefore, as compared to the auxiliary seal mechanism 54 being disposed on a radially outer side of the contact seal 48, the compressor can be reduced in size with respect to a radial direction.

Figure 5:
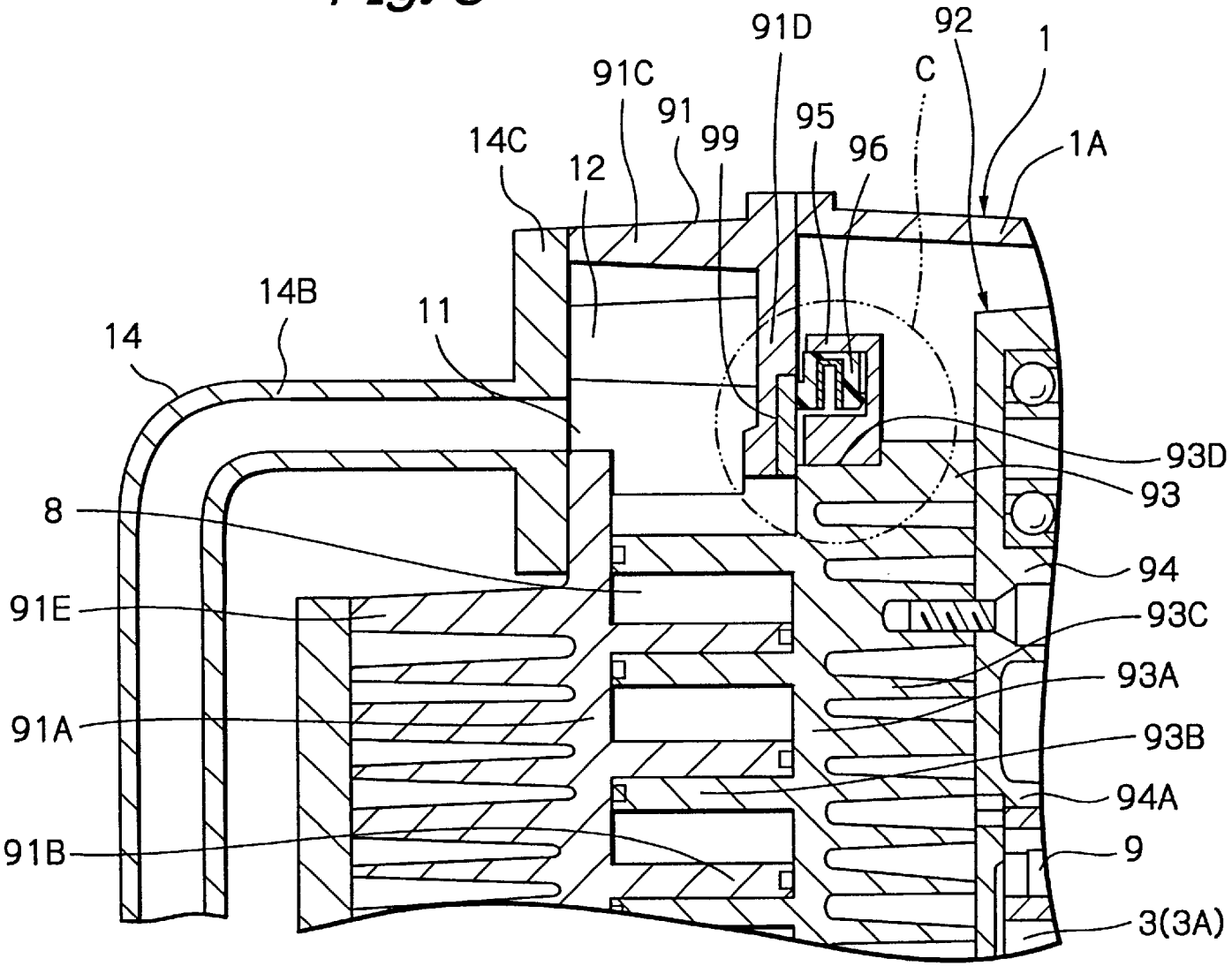
FIG. 5 is an enlarged, vertical cross-sectional view of a contact seal and its vicinities of a scroll gas compressor according to a third embodiment of the present invention.
Figure 6:
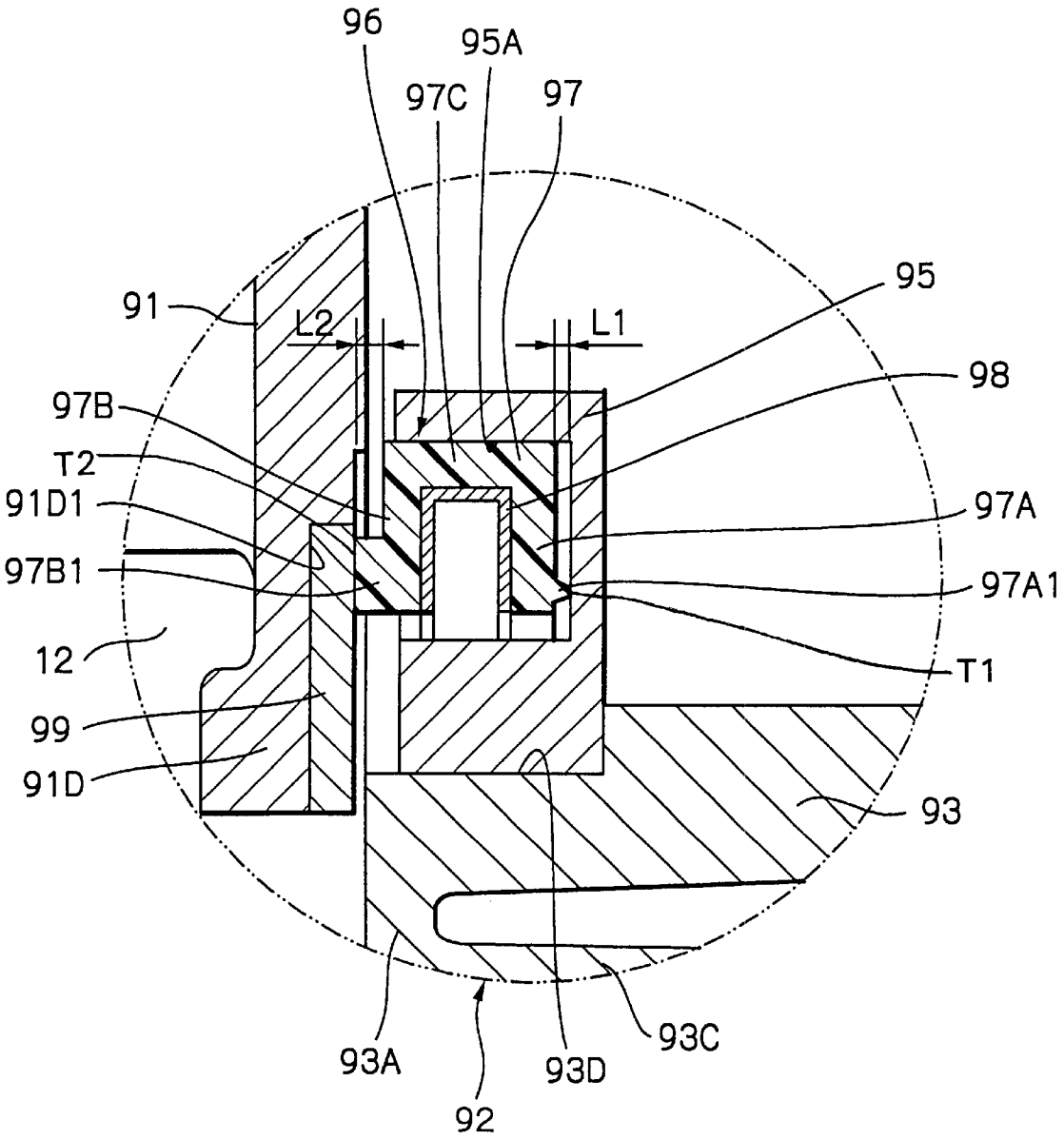
FIG. 6 is an enlarged view of a portion c in FIG. 5.
Figure 7:
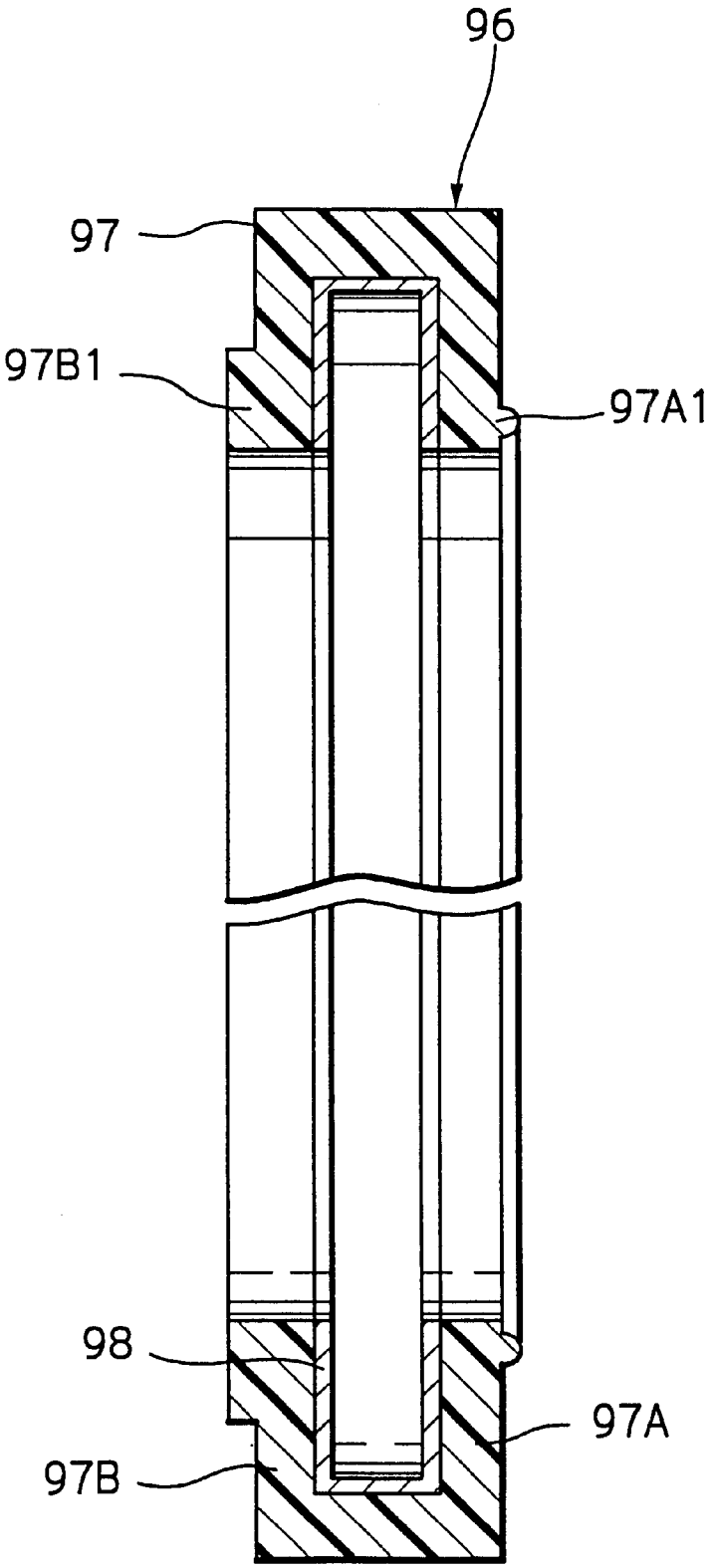
FIG. 7 is a cross-sectional view of a contact seal shown in FIG. 6 alone.

FIGS. 5 to 7 show a third embodiment of the present invention. The third embodiment is characterized in that in the seal ring providing the contact seal between the fixed scroll member and the orbiting scroll member, the fixed lip portion fitting against the seal mounting groove has a small contact area in contact with the seal mounting groove, while the sliding lip portion has a large contact area in slidable contact with the fixed scroll member.

In the third embodiment, the same portions or elements as used in the first embodiment are designated by the same reference numerals and characters, and an overlapping explanation is omitted.

Reference numeral 91 denotes a fixed scroll member according to this embodiment. The fixed scroll member 91 comprises an end plate 91A, a wrap portion 91B, an outer edge portion 91C, a ring-receiving portion 91D and radiating fins 91E. The ring-receiving portion 91D is cut so as to form a recess 91D1.

Reference numeral 92 denotes an orbiting scroll member according to this embodiment. The orbiting scroll member 92 comprises an orbiting scroll main body 93 and a rear plate 94. The orbiting scroll main body 93 comprises an end plate 93A, a wrap portion 93B and radiating fins 93C. An annular stepped portion 93D is formed in the end plate 93A. A boss portion 94A is formed in the rear plate 94.

Reference numeral 95 denotes a seal mounting member used in this embodiment, which is provided on an outer circumferential surface of the orbiting scroll member 92. The seal mounting member 95 is fittingly connected to the annular stepped portion 93D of the orbiting scroll member 92 and includes a seal mounting groove 95A formed therein.

Reference numeral 96 denotes a contact seal as a seal member used in this embodiment, which is provided in the seal mounting groove 95A of the seal mounting member 95. The contact seal 96 comprises a seal ring 97 and a spring member 98 which are described later.

The seal ring 97, which provides a part of the contact seal 96, comprises an elastic body made of a resin material. It has an opening on a radially inner side thereof and has a generally U-shaped cross-section. The seal ring 97 is provided in the seal mounting groove 95A of the seal mounting member 95.

The seal ring 97 comprises: a fixed-side annular plate portion 97A provided at the bottom of the seal mounting groove 95A and having a fixed lip portion 97A1; a sliding-side annular plate portion 97B provided at the opening of the seal mounting groove 95A and having a sliding lip portion 97B1; and a connecting cylindrical portion 97C connecting the annular plate portions 97A and 97B.

In the seal ring 97, the fixed lip portion 97A1 is fittingly contained in the seal mounting groove 95A and the sliding lip portion 97B1 is adapted to be slidably moved relative to a slidable contact ring 99 (described later) provided in the ring-receiving portion 91D of the fixed scroll member 91. Thus, the space between the fixed scroll member 91 and the orbiting scroll member 92 is gastightly sealed.

It should be noted that the fixed lip portion 97A1 of the seal ring 97 projects from the annular plate portion 97A so as to have a generally triangular or semi-circular cross-section. On the other hand, the sliding lip portion 97B1 of the seal ring 97 projects from the annular plate portion 97B so as to have a generally rectangular cross-section. The sliding lip portion 97B1 has an entirely flat surface in contact with the slidable contact ring 99.

Therefore, when T1 represents a contact area of the fixed lip portion 97A1 in contact with the seal mounting groove 95A and T2 represents a contact area of the sliding lip portion 97B1 in contact with the slidable contact ring 99, the relationship between T1 and T2 is expressed by the following equation (1).

$$T1<T2 \quad (1)$$

Consequently, when P1 represents a surface pressure acting on the surface of the fixed lip portion 97A1 in contact with the seal mounting groove 95A and P2 represents a surface pressure acting on the surface of the sliding lip portion 97B1 in contact with the slidable contact ring 99, the relationship between P1 and P2 is expressed by the following equation (2).

$$P1>P2 \quad (2)$$

Further, as shown in FIG. 6, when L1 represents a thickness of the fixed lip portion 97A1 of the seal ring 97 and L2 represents a thickness of the sliding lip portion 97B1, the relationship between L1 and L2 is expressed by the following equation (3).

$$L2>L1 \quad (3)$$

The spring member 98 is fittingly connected to an inner circumferential surface of the seal ring 97. The spring member 98 is made of a metallic material and has a U-shaped cross-section. It resiliently presses the fixed lip portion 97A1 and the sliding lip portion 97B1 of the seal ring 97 against the seal mounting groove 95A of the seal mounting member 95 and the slidable contact ring 99, respectively. The slidable contact ring 99 is fittingly connected to the ring-receiving portion 91D of the fixed scroll member 91.

Next, an operation of the scroll gas compressor in the third embodiment is described. Since the seal ring 97 is press fitted into the seal mounting groove 95A of the seal mounting member 95, when the contact seal 96 is brought into slidable contact with the slidable contact ring 99 during an orbital motion of the orbiting scroll member 92, a large frictional force is generated between the contact seal 96 and the seal mounting groove 95A. This frictional force provides a resistance to the sliding motion of the contact seal 96, and the contact seal 96 is slowly rotated relative to the seal mounting groove 95A or becomes substantially stationary relative to the seal mounting groove 95A.

Consequently, in the contact seal 96, the fixed lip portion 97A1 is subject to a rotary sliding motion at a low speed relative to the seal mounting groove 95A, and the sliding lip portion 97B1 of the contact seal 96, which is in contact with the slidable contact ring 99 of the fixed scroll member 91, is subject to an orbital sliding motion at a high speed relative to the slidable contact ring 99.

In the third embodiment, in the seal ring 97 of the contact seal 96, the contact area T1 of the fixed lip portion 97A1 in contact with the seal mounting groove 95A and the contact area T2 of the sliding lip portion 97B1 in contact with the slidable contact ring 99 are determined so as to have a relationship indicated by the equation (1).

Therefore, in the seal ring 97, the surface pressure P2 of the sliding lip portion 97B1 for a high-speed orbital sliding motion becomes lower than the surface pressure P1 of the fixed lip portion 97A1 [see the equation (2)]. Consequently, the rate of wear of the sliding lip portion 97B1 can be maintained at a low level, thus increasing durability and a life of the sliding lip portion 97B1.

After assembly of the scroll gas compressor, a slight gap may be partially formed between the fixed lip portion 97A1 of the contact seal 96 and the seal mounting groove 95A or between the sliding lip portion 97B1 and the slidable contact ring 99, due to poor machining accuracy or assembling errors of various parts of the compressor.

In this case, a running-in operation is required to be conducted. In the running-in operation, the contact seal 96 is positively worn by the seal mounting groove 95A and the slidable contact ring 99, to thereby reduce the above-mentioned gap and prevent leakage of a gas through the contact seal 96.

In the third embodiment, the surface pressure P1 of the fixed lip portion 97A1 for a low-speed rotary sliding motion is set to be high, as indicated by the equation (2). Therefore, the rate of wear of the fixed lip portion 97A1 is increased, and the time required for the running-in operation can be reduced.

Further, since the surface pressure P1 of the fixed lip portion 97A1 is increased, the sealing performance of the fixed lip portion 97A1 can be increased. Further, since the fixed lip portion 97A1 is subject to a low-speed rotary sliding motion, the rate of wear of the fixed lip portion 97A1 does not become extremely high even when the surface pressure P1 is set to be high, thus ensuring durability of the fixed lip portion 97A1.

Further, since the surface pressure P1 of the fixed lip portion 97A1 of the contact seal 96 can be set to be high by reducing the thickness L1 of the fixed lip portion 97A1, the fixed lip portion 97A1 readily fits against the bottom of the seal mounting groove 95A, and the sealing performance of the fixed lip portion 97A1 can be increased, thus preventing leakage of a gas.

Further, with respect to the sliding lip portion 97B1 of the contact seal 96, the thickness L2 is set to be large and the surface pressure P2 is set to be low. Therefore, the rate of wear of the sliding lip portion 97B1 can be decelerated.

In the above-mentioned embodiments, the contact seal is attached to the end plate of the orbiting scroll member. This does not limit the present invention. The contact seal may be attached to the ring-receiving portion of the fixed scroll member.

In the first to third embodiments of the present invention, a seal member comprising an elastic member having an opening on a radially inner side thereof and having a U-shaped cross-section is provided around an outer circumferential surface of the orbiting scroll member, so as to seal the compression chambers relative to outside air between the orbiting scroll member and the fixed-side member. Therefore, the seal member resiliently abuts against the orbiting scroll member and the fixed-side member, thus sealing the space between the two scroll members and preventing leakage of a gas supplied to the suction openings or a gas compressed in the compression chambers to the outside through the space between the orbiting scroll member and the fixed-side member.

In the first to third embodiments of the present invention, the fixed lip portion of the seal member fits against the seal mounting groove and the sliding lip portion is slidably moved relative to the fixed scroll member. This provides an gas-tight seal between the seal mounting groove and the fixed scroll member and the sealing performance of the seal member can be increased.

In the third embodiment, an annular seal mounting groove for mounting of the seal member is provided on the outer circumferential surface of the orbiting scroll member, and the seal member is arranged, such that the fixed lip portion has a small contact area in contact with the seal mounting groove and the sliding lip portion has a large contact area in contact with the fixed scroll member. Therefore, the fixed lip portion of the seal member can be brought into resilient contact with the seal mounting groove under high surface pressure, thus increasing the sealing performance of the fixed lip portion of the seal member relative to the seal mounting groove. Further, the fixed lip portion is subject to a rotary sliding motion at a low speed relative to the seal mounting groove. Therefore, even when the surface pressure of the fixed lip portion is set to be high, the rate of wear of the fixed lip portion does not become extremely high, thus ensuring durability of the fixed lip portion.

Further, the sliding lip portion of the seal member can be brought into contact with the fixed scroll member under low surface pressure. Thus, the rate of wear of the sliding lip portion can be maintained at a low level and durability of the sliding lip portion can be increased.

In the second embodiment, a partition wall member is provided in the fixed-side member so as to form an intermediate chamber between the fixed-side member and the orbiting scroll member. Further, an auxiliary seal means is provided between the partition wall member and the orbiting scroll member so as to enable a gas which has leaked into the intermediate chamber to be sealably contained in the intermediate chamber. Therefore, if a gas from the compression chambers leaks through the seal member, it is accommodated in the intermediate chamber, and prevented from leaking from the intermediate chamber to the outside by the auxiliary seal means.

Further, the gas in the intermediate chamber is allowed to escape to the outside through an escape means. Therefore, the gas in the intermediate chamber can be discharged through the escape means to an outdoor space and diffused into the atmosphere. Thus, the gas in the intermediate chamber is prevented from leaking to an indoor space in which the compressor is installed.

Further, in the first to third embodiments, a part of the gas prevented from leaking to the outside by the sliding lip portion is taken into the inside of the spring member, thus increasing the pressure of the gas inside the spring member. Consequently, due to the effect of spring resiliency of the spring member and the pressure of the gas inside the spring member, the fixed lip portion of the seal ring is pressed with a large force against the bottom of the seal mounting groove, while the sliding lip portion is pressed with a large force against the fixed scroll member. Therefore, leakage of a gas to the outside can be reliably prevented.

The entire disclosure of Japanese Patent Applications Nos. 2000-207138 filed on Jul. 7, 2000 and 2001-024354 filed on Jan. 31, 2001 including specification, claims, drawings and summary is incorporated herein by reference in its entirety.

What is claimed is:

1. A scroll compressor comprising:

a fixed-side member comprising a casing and a fixed scroll member provided in the casing, said fixed scroll member including an end plate and a spiral wrap portion standing on the end plate;

a driving shaft rotatably provided in the casing;

an orbiting scroll member orbitably provided at a distal end of the driving shaft, said orbiting scroll member including an end plate and a spiral wrap portion standing on the end plate, said wrap portion of the orbiting scroll member being adapted to overlap the wrap portion of the fixed scroll member so as to define a plurality of compression chambers;

a suction opening provided in the fixed-side member so as to communicate with the outermost compression chamber of said plurality of compression chambers;

a discharge opening provided in the fixed-side member so as to discharge a compressed gas from an inner compression chamber of said plurality of compression chambers to the outside; and a seal member comprising an elastic member provided around an outer circumferential surface of the orbiting scroll member, so as to seal the plurality of compression chambers relative to outside air between the orbiting scroll member and the fixed-side member, said seal member having an opening on a radially inner side thereof and having a generally U-shaped cross-section.

2. The scroll compressor according to claim 1, further comprising an annular seal mounting groove provided on the outer circumferential surface of the orbiting scroll member and having an opening facing the fixed scroll member, said seal member including a fixed lip portion adapted to fit against the seal mounting groove and a sliding lip portion slidable relative to the fixed scroll member.

3. The scroll compressor according to claim 2, wherein a contact area of the fixed lip portion in contact with the seal mounting groove is smaller than a contact area of the sliding lip portion in contact with the fixed scroll member.

4. The scroll compressor according to claim 2, wherein the sliding lip portion has a greater thickness than the fixed lip portion.

5. The scroll compressor according to claim 1, further comprising:

a partition wall member provided in the fixed-side member so as to surround the orbiting scroll member in a circumferential direction and form an intermediate chamber between the wall member and the orbiting scroll member, the intermediate chamber being adapted to accommodate the gas which has leaked from the compression chambers through the seal member; and an auxiliary seal means provided between the partition wall member and the orbiting scroll member, the auxiliary seal means being adapted to enable the gas which has leaked into the intermediate chamber to be sealably contained in the intermediate chamber.

6. The scroll compressor according to claim 5, further comprising an escape means adapted to allow an escape of the gas accommodated in the intermediate chamber to the outside.

7. The scroll compressor according to claim 1, wherein the seal member has a passage for allowing a part of the gas to flow into the inside of the seal member so as to increase sealing performance of the seal member.

8. A scroll compressor comprising:

a casing;

a fixed scroll member provided in the casing, said fixed scroll member including an end plate and a spiral wrap portion standing on the end plate;

a driving shaft rotatably provided in the casing;

an orbiting scroll member orbitably provided at a distal end of the driving shaft, said orbiting scroll member including an end plate and a spiral wrap portion standing on the end plate, said wrap portion of the orbiting scroll member being adapted to overlap the wrap portion of the fixed scroll member so as to define a plurality of compression chambers;

a suction opening communicated with the outermost compression chamber of said plurality of compression chambers;

a discharge opening adapted to discharge a compressed gas from an inner compression chamber of said plurality of compression chambers to the outside; and a seal apparatus provided on an outer circumferential surface of the orbiting scroll member, so as to seal the plurality of compression chambers relative to outside air between the orbiting scroll member and the fixed scroll member, said seal apparatus comprising:

a grooved, annular seal mounting member having an opening, said annular seal mounting member being attached to the outer circumferential surface of the orbiting scroll member so that the opening of the groove faces the fixed scroll member; and a ring-shaped seal member for providing an gas-tight seal between the fixed scroll member and the orbiting scroll member, said seal member being attached to the groove of the annular seal mounting member so as to allow a part of the gas to flow into the inside of the seal member and increase sealing performance of the seal member.

9. The scroll compressor according to claim 8, wherein the seal member comprises an elastic seal ring having an opening on a radially inner side thereof and having a generally U-shaped cross-section and a spring member provided on an inner circumferential surface of the seal ring.

10. The scroll compressor according to claim 9, wherein the seal ring comprises a fixed-side annular plate portion provided at the bottom of the groove of the seal mounting member, a sliding-side annular plate portion provided at the opening of the groove and a connecting cylindrical portion connecting a radially outer end of the fixed-side annular plate portion and a radially outer end of the sliding-side annular plate portion.

11. The scroll compressor according to claim 10, wherein the fixed-side annular plate portion has a fixed lip portion formed at a radially inner end thereof, said fixed lip portion being in contact with the bottom of the groove, and the sliding-side annular plate portion has a sliding lip portion formed at a radially inner end thereof, said sliding lip portion projecting from the groove and being slidable relative to a slidable contact ring provided in the fixed scroll member.

12. The scroll compressor according to claim 11, wherein the spring member is made of an elastic material and has a generally U-shaped cross-section, the spring member being fittingly connected between the fixed-side and sliding-side annular plate portions, to thereby press the fixed-side annular plate portion and the sliding-side annular plate portion in opposite directions and resiliently press the fixed lip portion and the sliding lip portion against the groove and the slidable contact ring, respectively.

13. The scroll compressor according to claim 12, wherein a passage is formed between the sliding-side annular plate portion and an inner peripheral wall surface of the annular seal mounting member which defines a part of the groove, so as to allow a part of the gas to flow into the inside of the spring member.

14. The scroll compressor according to claim 13, wherein the passage is further formed between the spring member and the inner peripheral wall surface of the annular seal mounting member.

15. The scroll compressor according to claim 11, wherein a contact area of the fixed lip portion in contact with the bottom of the groove is smaller than a contact area of the sliding lip portion in contact with the slidable contact ring of the fixed scroll member.

16. The scroll compressor according to claim 11, wherein the sliding lip portion has a greater thickness than the fixed lip portion.

* * * * *